US007819730B2

(12) United States Patent
Ascroft

(10) Patent No.: US 7,819,730 B2
(45) Date of Patent: Oct. 26, 2010

(54) FLUSH MOUNT OR DROP IN WOOD AND/OR WOOD COMPOSITION FLOOR VENT

(76) Inventor: Virgil David Ascroft, P.O. Box 572, Oxford, MI (US) 48371

( * ) Notice: Subject to any disclaimer, the term of this patent is extended or adjusted under 35 U.S.C. 154(b) by 810 days.

(21) Appl. No.: 11/435,632

(22) Filed: May 17, 2006

(65) Prior Publication Data

US 2006/0270336 A1 Nov. 30, 2006

Related U.S. Application Data

(60) Provisional application No. 60/685,049, filed on May 27, 2005, provisional application No. 60/754,030, filed on Dec. 27, 2005.

(51) Int. Cl.
*F24F 13/06* (2006.01)

(52) U.S. Cl. ..... 454/289; 454/284; 454/309; 454/332

(58) Field of Classification Search ..... 454/332, 454/333, 334, 284, 289, 309
See application file for complete search history.

(56) References Cited

U.S. PATENT DOCUMENTS

| | | | | | |
|---|---|---|---|---|---|
| 380,145 | A * | 3/1888 | Springer | 454/331 |
| 2,102,681 | A * | 12/1937 | Curtis | 454/331 |
| 2,207,679 | A * | 7/1940 | Gilpin | 105/375 |
| 2,722,170 | A * | 11/1955 | Broberg | 454/332 |
| 2,936,692 | A * | 5/1960 | White | 454/260 |
| 3,314,353 | A * | 4/1967 | Knab | 454/187 |
| 3,391,629 | A * | 7/1968 | Snell | 454/290 |
| 4,319,520 | A * | 3/1982 | Lanting et al. | 454/290 |
| 4,729,292 | A * | 3/1988 | Marton | 454/284 |
| 5,163,871 | A * | 11/1992 | Huibregtse et al. | 454/289 |
| 6,019,677 | A * | 2/2000 | Demster | 454/290 |
| 6,234,894 | B1 * | 5/2001 | Goracke et al. | 454/290 |
| 6,561,895 | B2 * | 5/2003 | McGill | 454/298 |
| 7,232,369 | B2 * | 6/2007 | Karidis et al. | 454/274 |
| 2003/0220069 | A1 * | 11/2003 | Orendorff | 454/290 |

FOREIGN PATENT DOCUMENTS

| | | | |
|---|---|---|---|
| FR | 2669408 | A1 * | 5/1992 |
| FR | 2706522 | A1 * | 12/1994 |

OTHER PUBLICATIONS

Fretworks Online Publication—Flush Mount Floor Vents, dated Apr. 13, 2004, located at http://web.archive.org/web/20040531035837/www.fretworks.com/vents/flushmont.html (with Examiner's annotations).*

* cited by examiner

*Primary Examiner*—Steven B McAllister
*Assistant Examiner*—Patrick F. O'Reilly, III

(57) ABSTRACT

The Flush Mount or Drop In Wood And/Or Wood Composite Vent is a floor register vent that is supported by an attached rigid plate, preferably metal, with matching vent slots to allow for manufacturing vents in materials including but not limited to prefinished flooring materials with the grain running the same way lengthwise and allows use of thin materials.

1 Claim, 4 Drawing Sheets

FLUSH MOUNT VENT FRAME

FIG 1 FLUSH MOUNT VENT FRAME
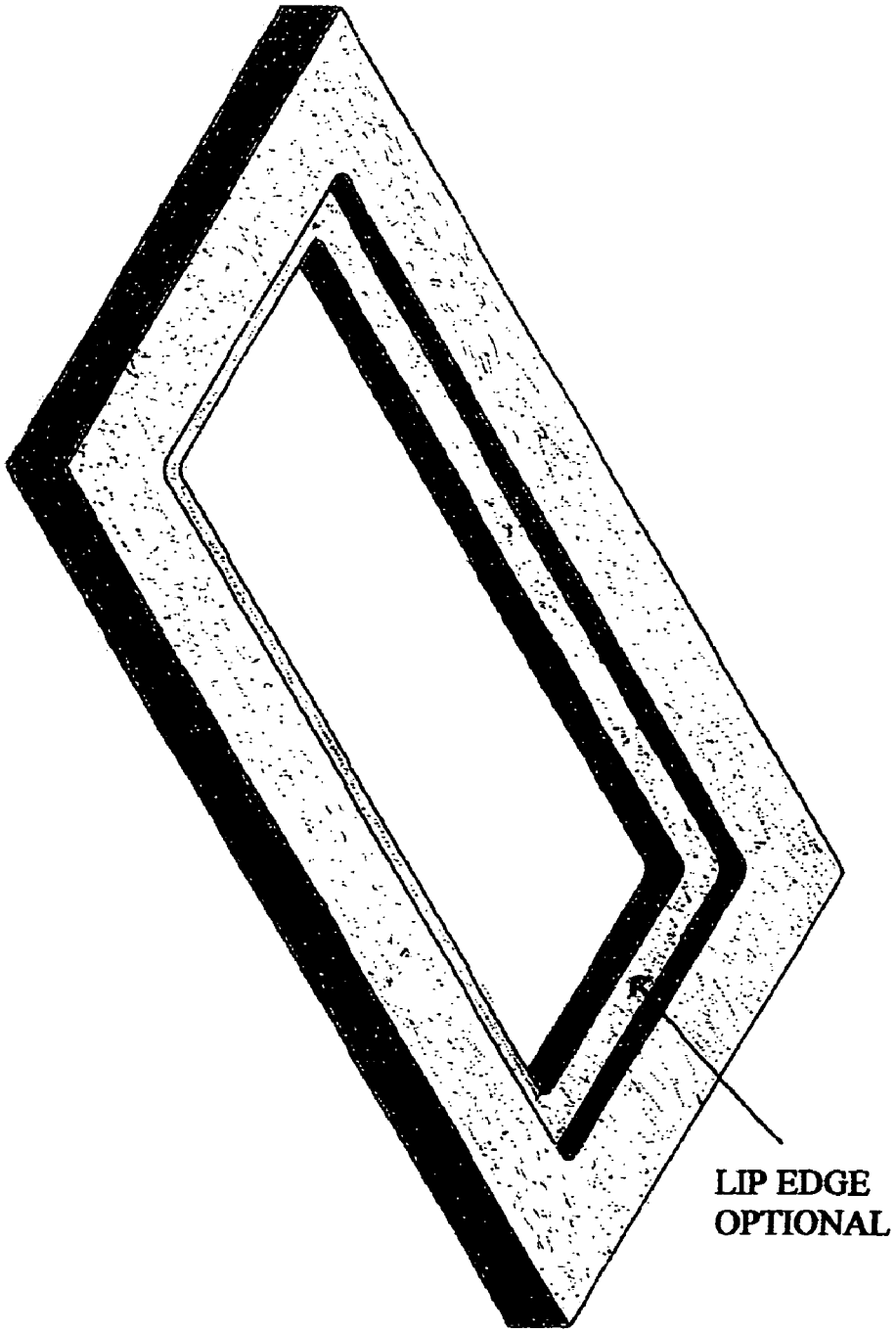

FIG 2 FLUSH MOUNT VENT INSERT
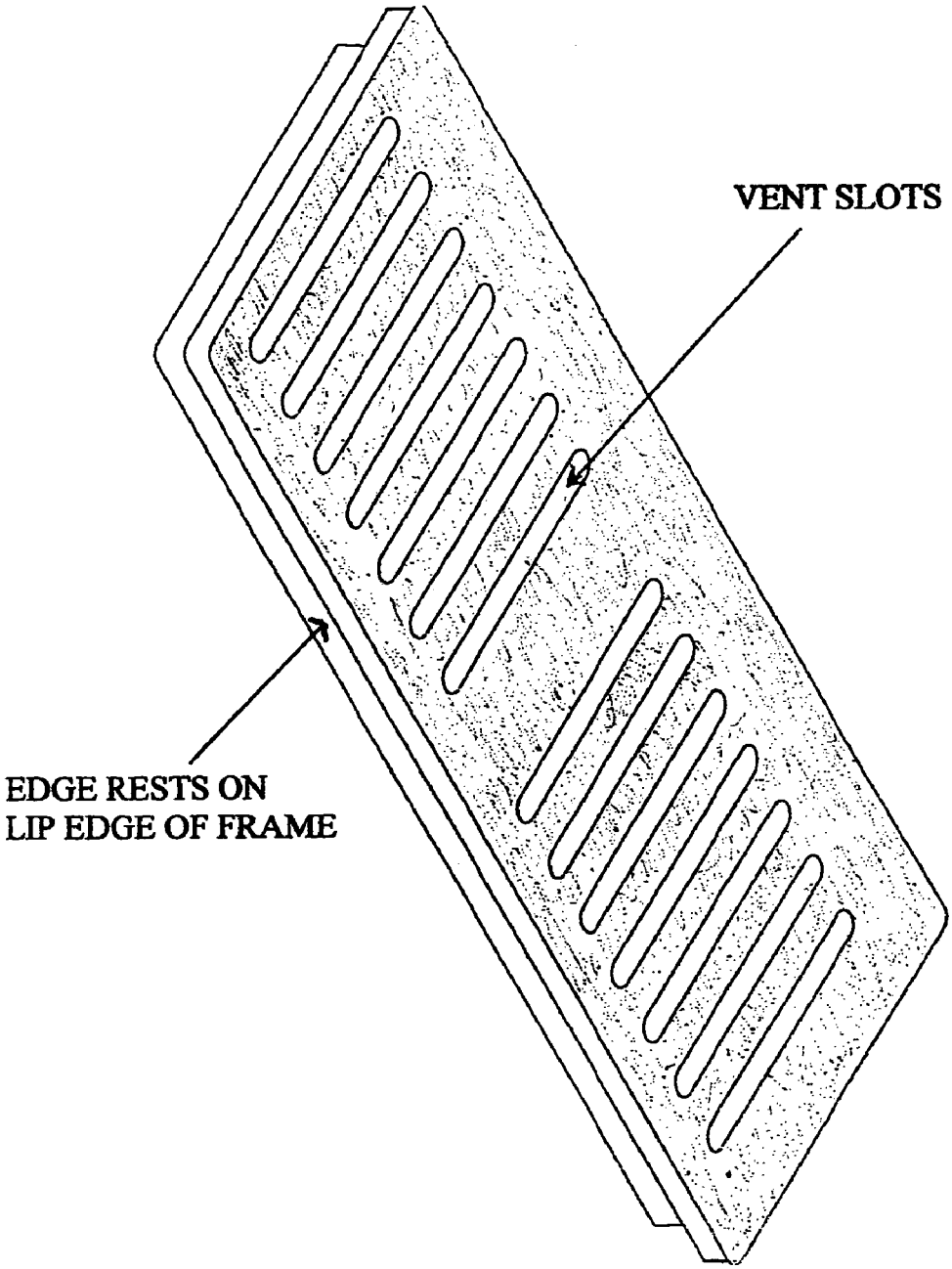

FIG 3 FLUSH MOUNT OR DROP IN VENT SUPPORT PLATE
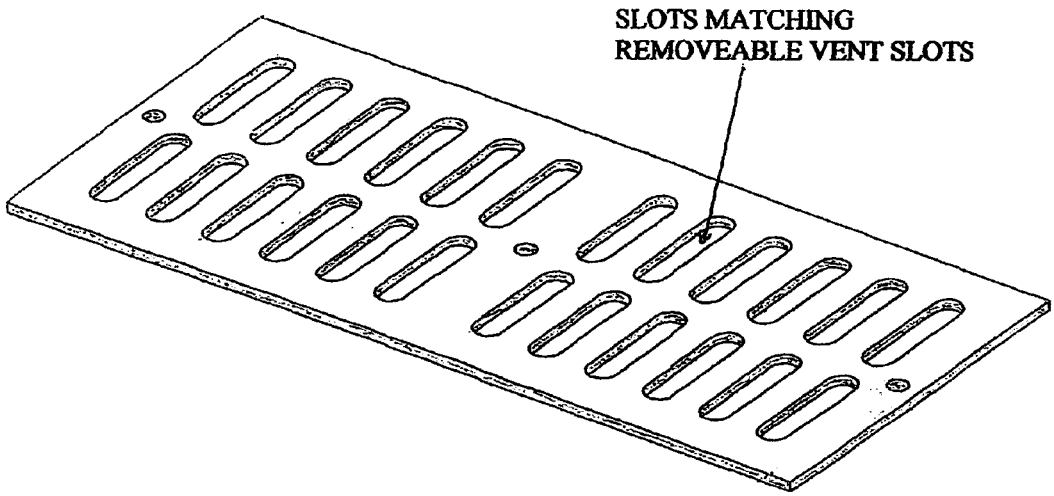

FIG 4 DROP IN VENT
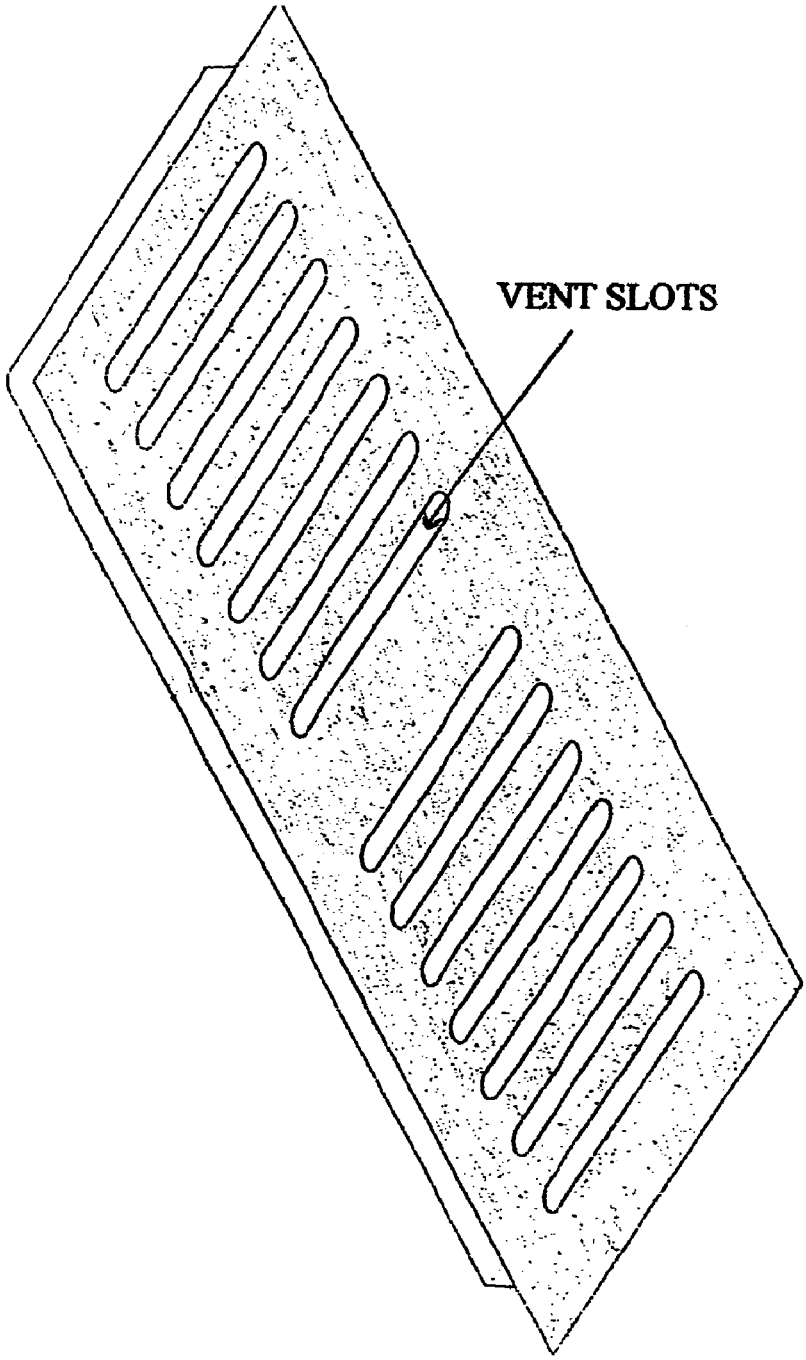

FLUSH MOUNT OR DROP IN WOOD AND/OR WOOD COMPOSITION FLOOR VENT

CROSS REFERENCE TO RELATED CLAIMS

This invention application proclaims benefit of Provisional Patent Filings No. 1461 Dated May 27, 2005 Application No. 60/685,049 and No. 4012 Dated Dec. 27, 2005 Application No. 60/754,030 which are the same process.

BACKGROUND OF THE INVENTION

Field of the Invention

This invention relates generally to the field of apparatus for a Wood And/Or Wood Composite Floor Vent. Moreover it pertains specifically to such apparatus for a Flush Mount or Drop In Wood And/Or Wood Composite Floor Vent.

BRIEF SUMMARY

This invention consists of a metal or other flex resistant material to be mounted to the underside of the removable flush mount or drop in vent with matching vent slots for such support as to allow for the use of wood material with continuous direction lengthwise grain and thin materials to be manufactured including prefinished and engineered wood composite materials thereby providing matching vent to flooring material.

In the past, wood vents had to be manufactured from unfinished wood in a manner that prohibited use of many types of popular woods such as handscraped, textured, or engineered wood. In addition, wood vents made from unfinished wood had to be stained and sealed, resulting in difficulty matching the color, finish and height of many materials. The structural support plate enables the vent to be made from very thin materials that could not be used previously. The structural plate also allows the vent to be made with the grain running one consistent direction including the slats. This method allows the use of prefinished wood. Previously, wood vents manufactured with the slats running opposite of the remainder of the vent were necessary for proper strength with many materials. It is not feasible to manufacture prefinished vents with cross grained slats. This device insures a perfect matching vent and enables the use of virtually any species or thicknesses of wood and/or composite materials.

The foregoing has outlined, in general, the physical aspects of the invention and is to serve as an aid to better understanding the more complete detailed description, which is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration the advantages and objects of the present invention. Each drawing is referenced by corresponding figure reference characters with the "DETAILED DESCRIPTION OF THE INVENTION" section to follow.

FIG. 1. is a perspective view of a Frame of the Flush Mount Wood And/Or Wood Composite Vent according to the present invention.

FIG. 2. is a perspective view of an Insert of the Flush Mount Wood And/Or Wood Composite Vent according to the present invention.

FIG. 3. is a perspective view of a Supporting Metal Plate of the Flush Mount or Drop In Wood or Wood Composite Vent according to the present invention.

FIG. 4. is a perspective view of a Drop In Wood Vent according to the present invention.

DETAILED DESCRIPTION OF THE INVENTION

Referring now descriptively to the drawings, the attached figures illustrate a Flush Mount or Drop In Wood And/Or Wood Composite Floor Vent.

FIGS. 1 and 2 illustrate a Flush Mount Wood And/Or Wood Composite Floor Vent according to the present invention.

FIG. 3 illustrates a supporting metal plate to be mounted to the underside of FIG. 2 or FIG. 4 according to the present invention.

FIG. 4 illustrates a Drop In Wood Vent according to the present invention.

In FIG. 1, the wood frame has the grain running the same way lengthwise, the length, width and height of the frame is determined by the flooring material used and vent opening in the floor. The frame can have a lip edge to support removable vent.

In FIG. 2, the removable wood insert with slots for venting has the grain running the same way as the frame, and can mount inside the frame with or without a lip edge.

In FIG. 3, the supporting rigid plate, preferably metal, with slots matching the wood vent slots is to be mounted on the underside of FIG. 2 or 4 with fasteners or construction adhesive.

FIG. 4 depicts a wood drop-in vent with the grain running lengthwise.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

U.S. PATENT DOCUMENTS

U.S. Pat. No. 380,145A March 1888 Springer
U.S. Pat. No. 2,102,681A December 1937 Curtis Herbert F
U.S. Pat. No. 2,722,170A November 1955 Johan Broberg George Karl
U.S. Pat. No. 2,936,692A May 1960 White Ray C
U.S. Pat. No. 3,391,629A July 1968 Snell Ellwood L
U.S. Pat. No. 4,729,292A March 1988 Marton Lewis
U.S. Pat. No. 6,019,677A February 2000 Demter, Stanley J.
U.S. Pat. No. 6,561,895B2 May 2003 McGill, Joseph A.
U.S. Pat. No. 7,232,369B2 June 2007 Karidis et al.

Accordingly the advantages and objects of the present invention are:

1. A flush mount or drop-in wood floor vent device, which is structurally supported so as to allow the manufacturing from a wood material of various thicknesses, finishes, and textures, with the grain of the vent and frame running the same way lengthwise, and to allow the floor vent to match the surrounding wood flooring, the floor vent comprising:

a removable vent manufactured from wood and being sized to cover a floor air vent hole, the removable vent including an upper planar portion formed from a single piece of wood having a continuous grain running in a lengthwise direction throughout the single piece of wood, the upper planar portion comprising a plurality of widthwise extending portions defining a first plurality of elongated air slots disposed therebetween and formed within the single piece of wood;

a flat flex-resistant metal support plate mounted to the underside of the removable vent and being provided with a second plurality of elongated air slots matching the first plurality of elongated air slots in the removable vent;

fasteners or strong adhesive attaching the support plate to the vent; and a wood frame to hold the removable vent, the wood frame including an upper planar portion formed from a single piece of wood having a continuous grain running in a lengthwise direction throughout the single piece of wood.

* * * * *